United States Patent [19]

Kurt

[11] Patent Number: 4,572,680

[45] Date of Patent: Feb. 25, 1986

[54] STAMPING APPARATUS FOR PROVIDING WORKPIECES WITH DIFFERENT EMBOSSED MARKS

[76] Inventor: Stangl Kurt, Hauptstrasse 17a, A-4863 Seewalchen, Austria

[21] Appl. No.: 476,040

[22] Filed: Mar. 17, 1983

[30] Foreign Application Priority Data

May 10, 1982 [AT] Austria ..... 1812/82

[51] Int. Cl.[4] ..... B41J 3/10

[52] U.S. Cl. ..... 400/121; 400/127; 400/176

[58] Field of Search ..... 101/93.04, 3 R, 4, 18, 101/29, 93.05; 400/125, 121, 122, 127, 124, 176, 179

[56] References Cited

U.S. PATENT DOCUMENTS

| | | | |
|---|---|---|---|
| 975,010 | 11/1910 | Young . | |
| 1,028,037 | 5/1912 | Lilleberg | 400/124 |
| 3,226,530 | 12/1965 | Greenblott et al. | 400/121 X |
| 3,242,855 | 3/1966 | Noll et al. | 101/3 R X |
| 4,027,762 | 6/1977 | Nakauchi | 400/124 |
| 4,036,128 | 7/1977 | Easton | 101/29 X |
| 4,159,676 | 7/1979 | Joyce et al. | 101/3 R |
| 4,218,971 | 8/1980 | Uhl et al. | 400/125 X |

FOREIGN PATENT DOCUMENTS

| | | | |
|---|---|---|---|
| 2201756 | 7/1973 | Fed. Rep. of Germany | 400/124 |
| 2458334 | 8/1975 | Fed. Rep. of Germany . | |
| 1935090 | 11/1978 | Fed. Rep. of Germany | 101/4 |
| 2459086 | 2/1981 | France | 101/93.04 |
| 0100174 | 7/1980 | Japan | 400/122 |
| 629121 | 4/1982 | Switzerland . | |
| 2046176 | 11/1980 | United Kingdom | 101/93.04 |

*Primary Examiner*—Clifford D. Crowder
*Attorney, Agent, or Firm*—Kurt Kelman

[57] ABSTRACT

Apparatus for stamping different embossed marks into metallurgical or rolled products comprises a plurality of juxtaposed punches, which are axially slidably mounted in a punch holder, and a punch actuator for actuating said punches. To permit a stamping of different embossed marks at a high stamping rate, each punch carries a pattern segment of a set of pattern segments, which are adapted to be assembled to form different patterns corresponding to respective embossed marks. In the punch actuator, a separate punch-actuating cylinder which is fluid-operable is associated with each punch. The punch actuator comprises a controller for controlling the supply of pressure fluid to each of the punch-actuating cylinders or to groups of said cylinders.

2 Claims, 3 Drawing Figures

STAMPING APPARATUS FOR PROVIDING WORKPIECES WITH DIFFERENT EMBOSSED MARKS

BACKGROUND OF THE INVENTION (a) Field of the Invention

This invention relates to stamping apparatus for providing workpieces, such as metallurgical or rolled products, with different embossed marks, which apparatus comprises a plurality of juxtaposed punches which are axially slidably mounted in a punch holder, and a punch actuator for selectively actuating at least one of said punches.

(b) Prior Art

In known apparatus of that kind, each punch carries a pattern corresponding to one of the embossed marks which are to be formed. To provide a workpiece with one of said embossed marks, the associated punch is moved by means of the punch holder into registry with the punch actuator, which usually consists of a fluid-operable cylinder. The punch holder usually consists of a carriage, which is movable transversely to the punch actuator, or of a wheel, which carries the punches arranged in a circular series, so that the wheel can be rotated to move the required punch to its stamping position. These known designs have the disadvantage that, for the provision of a given mark, the punch holder must be moved to a position in which the punch provided with the required pattern registers with the punch actuator. This requires a separate control movement so that the stamping rate is highly restricted. Besides, the required control movement involves expensive control structures. Only a small number of different embossed marks can be provided by means of that apparatus so that a larger number of stamping operations are required for a sufficiently large information.

SUMMARY OF THE INVENTION

It is an object of the invention to avoid these disadvantages and to provide apparatus which is operable to provide metallurgical or rolled products with a relatively large number of different embossed marks at a high stamping rate and can be built at low cost.

In apparatus of the kind described first hereinbefore, this object is accomplished according to the invention in that each punch carries a pattern segment of a set of pattern segments which are adapted to be assembled to form different patterns. The punch actuator comprises a plurality of fluid-operable cylinders, which are associated with respective ones of the punches and a controller controls the supply of pressure fluid to a selected fluid-operable cylinder or to a selected group of said cylinders.

Because a separate punch is not provided for each embossed mark, the punch holder need not be moved to a position in which a given punch is in the stamping position. The different patterns corresponding to the different embossed marks are assembled from the several pattern segments, which preferably constitute the seven bars of a segmented figure eight. Such pattern segments can be used in different combinations to form, e.g., twentytwo alphanumeric characters. To provide a given embossed mark, it is sufficient to operate those fluid-operable cylinders which are associated with the punches which carry the segments of the corresponding pattern. The division of the patterns into a plurality of pattern segments, which can be combined in different patterns, will ensure a high stamping rate because there is no need for a movement of the punch holder relative to the punch actuator between the stamping of two different embossed marks. For a given size of the embossed marks, the mass of each punch is relatively small so that a high acceleration can be obtained by a small driving power. The fact that each pattern is composed of certain pattern segments carried by respective punches affords the additional advantage that the embossed marks can be clearly recognized even when they have been provided on uneven surfaces of the workpiece because each punch is actuated by a separate fluid-operable cylinder so that the pattern segment carried by each punch is forced at least in part into the product to be marked. Whereas the strokes of the several punches may differ, this will not affect the simultaneous actuation of the punches to be used in a given case.

Owing to the fact that in accordance with the invention each pattern is divided into a plurality of segments carried by respective punches, which are selectively actuated, the embossed marks have the same appearance as the alphanumeric characters of conventional emitter displays so that the control of the supply of pressure fluid to the several cylinders can be derived from such emitter display.

A further advantage afforded by the invention resides in that only a few different punches are required because some of the pattern segments may be obtained by an angular movement of the same punches as each pattern segment consists only of a bar or a series of dots.

Because the different patterns are composed of several segments, the punches carrying said segments must be disposed as close as possible to each other but must still be slidable relative to each other. This can be ensured in a particularly desirable manner if, according to a preferred feature of the invention, each punch constitutes a slide track for each adjacent punch.

BRIEF DESCRIPTION OF THE DRAWING

The invention is illustrated by way of example on the drawing, in which.

DESCRIPTION OF PREFERRED EMBODIMENT

Figure 1:
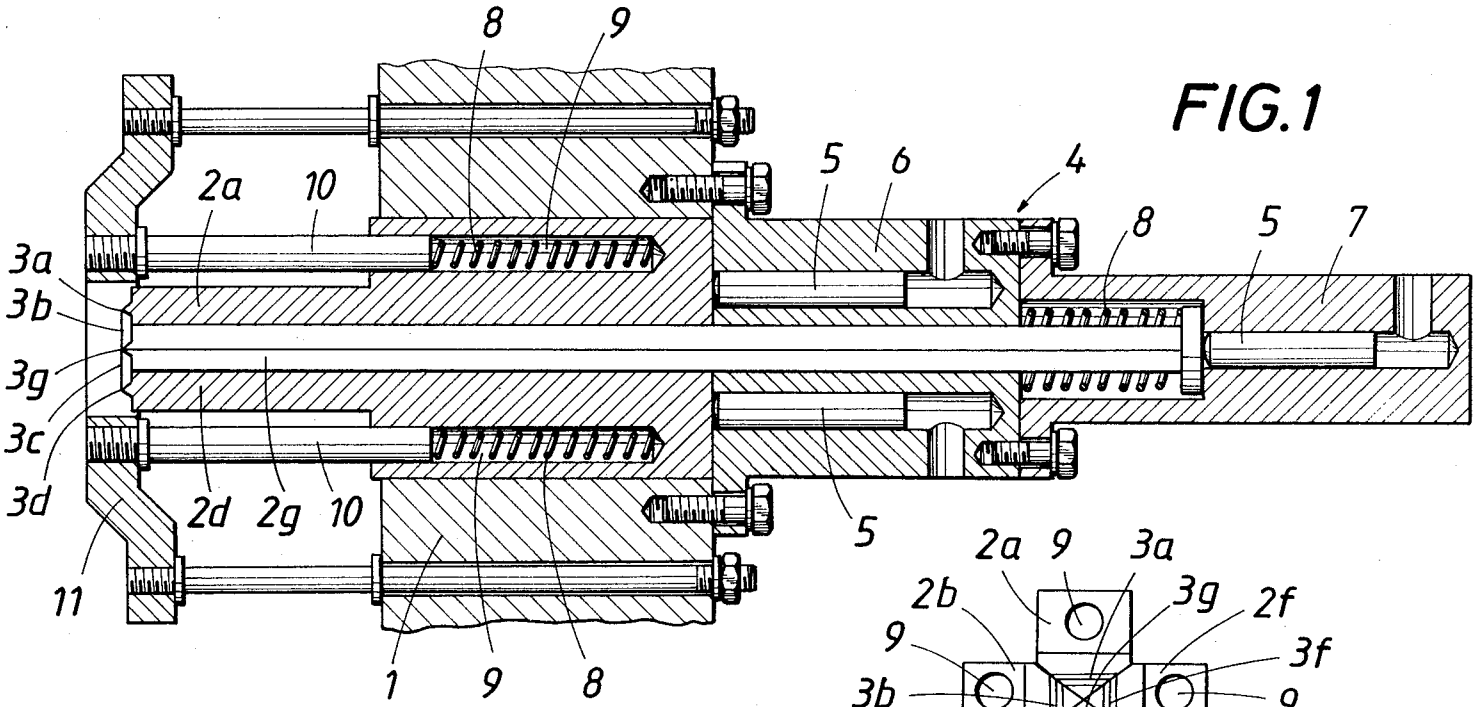
FIG. 1 is a simplified axial sectional view showing apparatus according to the invention for providing metallurgical or rolled products with different embossed marks.

As is apparent from FIG. 1, a plurality of juxtaposed punches 2*a*, 2*b*, 2*c*, 2*d*, 2*e*, 2*f* and 2*g* are mounted in the punch holder 1. Each punch is axially guided in the punch holder 1 and constitutes a slide track for each adjacent punch so that the spacing of the punches can be minimized. At its forward end face, each of the punches 2*a* to 2*g* carries one of the bar-shaped pattern segments 3*a*, 3*b*, 3*c*, 3*d*, 3*e*, 3*f* and 3*g*. These pattern segments 3*a* to 3*g* can be assembled to form different patterns. For this purpose, each of the punches 2*a* to 2*g* is associated with a fluid-operable punch-actuating cylinder of a punch actuator 4. The pistons 5 of the punch-actuating cylinders associated with the punches 2a to 2f are mounted in a common cylinder housing 6. The punch 2g is surrounded and guided by the punches 2a to 2f and extends through the cylinder housing 6 into the housing 7 of a punch-actuating cylinder which is mounted on the cylinder housing 6 and has a piston 5 associated with the punch 2g.

The arrangement is such that the piston 5 of each punch-actuating cylinder is biased by a return spring 8. Each of these return springs does not act directly on the associated punch-actuating piston 5 but on the associated one of the punches 2a to 2g so that each return spring can be used to hold both the associated punch and the associated piston in their initial positions. The return springs 8 associated with the punches 2a to 2f are inserted into bores 9 formed in said punches and bear on rods 10, which are carried by a yoke 11 secured to the punch holder 1 so that the punches 2a to 2f engage the cylinder housing 6 when the punch-actuating pistons 5 are in their initial position. Similarly, the return spring 8 associated with the punch 2g and bearing on the cylinder housing 6 will urge the punch 2g against the punch-actuating piston 5 of the associated cylinder. When the punches are actuated individually or in groups by the punch-actuating cylinders, the actuated punches will stamp into the workpiece an embossed mark, which is composed of the pattern segments carried by the actuated punches.

Figure 3:
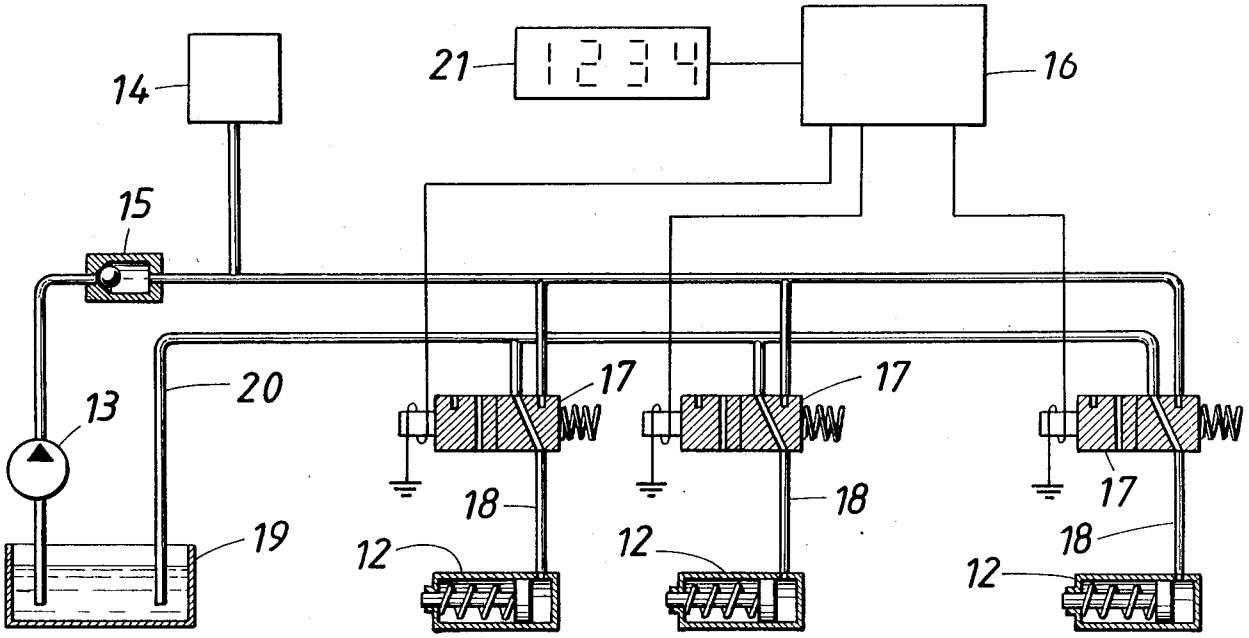
FIG. 3 is a block circuit diagram of the system for controlling the punch-actuating cylinders.

As is shown in FIG. 3, pressure fluid is supplied to the several punch-actuating cylinders 12 from a pressure accumulator 14, which is fed through a check valve 15 from a pump 13. The provision of the pressure accumulator 14 ensures that a supply of fluid under adequate pressure to all punch-actuating cylinders 12 can be ensured so that the same conditions will be provided for all punch-actuating cylinders 12 and an adequate acceleration will be imparted to each punch. The several punch-actuating cylinders 12 are controlled by a controller 16 which controls the control valves 17 incorporated in respective supply conduits 18 leading to respective punch-actuating cylinders 12. When the control valves 17 are in their initial positions, shown on the drawing, the supply conduits 18 are connected by the control valves 17 to a drain conduit 20 which communicates with a reservoir 19. When the control valves 17 are actuated individually or in groups by the controller 16, the actuated control valves 17 will connect the associated supply conduits 18 to the pressure accumulator 14 so that the punch-actuating pistons of the corresponding punch-actuating cylinders 12 will be actuated and the associated punches will be advanced. When the control valves 17 have been reset, the return springs 8 will return the advanced punches to their initial position so that the pressure fluid will be forced from the punch-actuating cylinders 12 into the reservoir 19.

Figure 2:
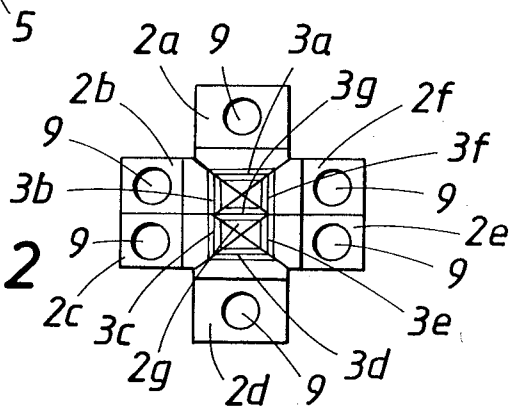
FIG. 2 is an end elevation showing the punches of that apparatus, which punches are provided with pattern segments which are adapted to be assembled to form patterns corresponding to the embossed marks.

As is apparent from FIG. 2, the pattern segments 3a to 3g can be assembled to form different embossed marks, which are similar to conventional emitter displays. For this reason, the control of the apparatus can be derived from an emitter display 21. For instance, if the embossed mark to be provided on the workpiece consists of a figure "1", which is displayed by the display field at the left-hand end of the emitter display 21, the punches 2b and 2c carrying the corresponding pattern segments 3b and 3c must be forced into the product to be marked. The supply of fluid to the associated cylinders can be controlled in a simple manner by the controller 16. For the provision of a mark corresponding to the figure "2", which in the emitter display 21 appears in the second field from the left, the punches 2a, 2b, 2g, 2e and 2d must be actuated so that the controller 16 must cause a supply of fluid to the associated punch-actuating cylinders 16. It will be understood that the patterns on the punches must be mirror images of the embossed marks which are desired; this need not be explained in detail. The punches 2a to 2g constitute a set of punches carrying respective pattern segments, which can be assembled as desired to form patterns corresponding to respective embossed marks.

What is claimed is:

1. Apparatus for stamping embossed marks into a metal workpiece, comprising a punch holder, a plurality of rigid rectilinear punches juxtaposed over their entire length and axially slidably mounted in said punch holder, a pattern segment provided on each of said punches on an end face thereof, and a pressure fluid-operable punch actuator for axially reciprocating respective ones of said punches, wherein said punch actuator comprises a pressure fluid source, a like plurality of cylinders operatively connected to said pressure fluid source and associated with respective ones of said punches, the cylinders being axially spaced from the respective punches, axially reciprocable pistons in said cylinders separate and independent of said punches and selectively operable to actuate the associated punches, and a controller for controlling the supply of the pressure fluid from said source to each one of said cylinders, and said juxtaposed punches are mounted in said punch holder in such an arrangement that each punch constitutes a slide track over the entire length thereof for axially guiding an adjacent one of said punches while the pistons associated with juxtaposed ones of said punches are spaced from each other, and said pattern segments are so designed and arranged that said punches are adapted to be actuated in any of a plurality of combinations in which said pattern segments of said actuated punches form different patterns.

2. The improvement set forth in claim 1, wherein said pressure fluid source comprises a pressure fluid accumulator, a check valve, and a pump connected to said pressure fluid accumulator by said check valve and operable to supply the pressure fluid to said pressure fluid accumulator, and said controller is adapted to control the supply of the pressure fluid from said pressure fluid accumulator to said cylinders.

* * * * *

UNITED STATES PATENT AND TRADEMARK OFFICE

CERTIFICATE OF CORRECTION

PATENT NO. : 4,572,680

DATED : FEBRUARY 25, 1986

INVENTOR(S) : KURT STANGL

It is certified that error appears in the above-identified patent and that said Letters Patent are hereby corrected as shown below:

Cover page, item [76] , inventor's name should be --Kurt Stangl--.

Signed and Sealed this

*Seventeenth* Day of *June 1986*

[SEAL]

*Attest:*

DONALD J. QUIGG

*Attesting Officer*

*Commissioner of Patents and Trademarks*